United States Patent [19]

Bosniack

[11] 4,079,012

[45] Mar. 14, 1978

[54] SYNTHETIC ESTER OIL COMPOSITIONS CONTAINING ORGANIC SULFONIC ACID AMMONIUM SALTS AS LOAD-CARRYING AGENTS

[76] Inventor: David S. Bosniack, 217 Post Oak Dr., Baytown, Tex.

[21] Appl. No.: 729,837

[22] Filed: Oct. 4, 1976

[51] Int. Cl.[2] ..... C10M 1/40; C10M 3/34; C10M 5/22; C10M 7/38

[52] U.S. Cl. ..... 252/33.4; 252/56 S; 252/391; 252/402

[58] Field of Search ..... 252/33.4, 56 S, 391, 252/402

[56] References Cited

U.S. PATENT DOCUMENTS

| | | | |
|---|---|---|---|
| 2,629,676 | 2/1953 | Prutton | 252/33.4 |
| 2,650,198 | 8/1953 | Kronig et al. | 252/33.4 |
| 2,715,107 | 8/1955 | Talley et al. | 252/33.4 |
| 2,902,449 | 9/1959 | Hopfner et al. | 252/33.4 |
| 2,911,368 | 11/1959 | Fowler et al. | 252/34 |
| 3,425,953 | 2/1969 | Cowan | 252/33.4 |
| 3,634,242 | 1/1972 | Bosniack et al. | 252/34 |
| 3,642,632 | 2/1972 | Coburn et al. | 252/51.5 A |

*Primary Examiner*—Delbert E. Gantz
*Assistant Examiner*—Irving Vaughn
*Attorney, Agent, or Firm*—Wayne Hoover; Eugene Zagarelle

[57] ABSTRACT

A neutral oil soluble organosulfonic acid ammonium salt formed by reaction of $C_1$-$C_{26}$ sulfonic acid with a nitrogen base chosen from the group consisting of mono-, di-, and tertiary amines, acid addition salts of such amines, or quaternary ammonium compounds, the nitrogen base having at least one hydrocarbyl group containing from about $C_1$ to $C_{36}$ carbon atoms, is added to an oil composition to improve the load-carrying capacity of the oil composition. The sulfonic ammonium salts are particularly effective in synthetic ester lubricants used in turbine engines. The oil compositions of this invention are also compatible with the silicone and fluorosilicone seals used in such engines.

14 Claims, No Drawings

SYNTHETIC ESTER OIL COMPOSITIONS CONTAINING ORGANIC SULFONIC ACID AMMONIUM SALTS AS LOAD-CARRYING AGENTS

BACKGROUND OF THE INVENTION

This invention relates to new and improved oil compositions, and more particularly it relates to oil compositions prepared from synthetic ester lubricating oils.

Deterioration of lubricating oils and formation of harmful deposits under high performance service conditions is a major problem in providing satisfactory lubrication of engines which are subjected to high temperatures such as internal combustion engines. This problem is especially acute in lubricating engines of the gas turbine and jet engine type, e.g., turbojet, turboprop, or prop-jet, turbofan, and supersonic jet transport engines, where lubricants encounter extremely high temperatures. These severe service conditions, which favor oxidation reactions, can break a lubricant down into harmful acidic products which attack the metal and rubber parts of the engine or which may act as further oxidation catalysts.

The early development of the gas turbine was carried out using relatively conventional mineral oil lubricants. With further development of this engine, it became clear that mineral oils were unable to satisfy the demands placed on the lubricant by the extremes of temperature that occur within these high performance engines. Oxidation instability at high temperature and inadequate viscosity index were two of the major disadvantages of mineral oil lubricants. Attempts were made to incorporate additives into the mineral oil lubricants to improve their performance. For example, viscosity index improvers, thickeners, or other highly nonvolatile additives were incorporated in mineral oil lubricants to improve their performance, but these additives proved to be undesirable for use in such engines because of their tendency to leave a residue which accumulates and interferes with the operation of the engines.

The prior art has discovered that lubricants based on synthetic ester oils perform far more satisfactorily than mineral oils in meeting the conditions encountered in jet engines, but because of the severe operating conditions, such ester base oils, without further compounding also tend to rapidly decompose, corrode metals and vital engine parts, and attack synthetic rubber oil seals even though improved metal alloys and oil seals are now conventionally employed.

The problem of attack of rubber oil seals is especially acute with oil seals made of silicone elastomers. Nearly all engines and/or accessories made today, both of the commercial and military type, have some silicone seals which come in contact with the lubricant. Thus, an oil in time may cause cracks in the seal resulting in oil loss and other related problems. Further, lubricants used in high performance jet engines are forced to bear a high load. The lubricating art is filled with myriads of corrosion inhibitors and load carrying improvers. Unfortunately, many of the load-carrying additives which have been used in synthetic ester oil lubricants have a damaging effect on silicone seals.

To overcome these problems, the prior art has continued to search for new additives which can be incorporated into the synthetic ester oils to improve their properties. For example, as disclosed in U.S. Pat. No. 3,720,612, which was granted on Mar. 13, 1973 and which is assigned to the same assignee as the present application, trihydrocarbyl neutral phosphate ester additives and amine neutralized addition salts of one or more acidic phosphate esters of between about 14 and about 60 carbon atoms per salt molecule are incorporated in synthetic ester oils to provide the ester oils with improved load carrying properties and to reduce their propensity to attack silicone elastomer seals. Because of the constant upgrading of the performance requirements of turbo engines, a continuing search, however, goes on for additives having still better properties.

SUMMARY OF THE INVENTION

It has now been discovered, in accordance with the present invention that organo sulfonic acid ammonium salts containing a $C_1$ to $C_{26}$ sulfonic acid group and an ammonium group derived from an organic nitrogen containing base selected from the group consisting of mono-, di- or tertiary amines, or acid addition salts or quaternary ammonium salts of such amines, can be incorporated in synthetic ester lubricating oils to provide novel and useful lubricating oil compositions. The ammonium group has the general formula $NR^1R^2R^3R_x^4$ wherein $R_1R_2R_3$ and $R_4$ are each hydrogen or $C_1$ to $C_{36}$ hydrocarbyl groups, provided that at least one of $R_1$, $R_2$, $R_3$ or $R_4$ is $C_1$ to $C_{36}$ hydrocarbyl group and $x$ is 0 or 1.

The lubricating compositions of this invention are particularly useful in lubricating gas turbine engines containing silicone or fluorosilicone seals because they do not cause deterioration or shrinking of such seals and have a high load carrying capability. The organosulfonic acid ammonium salts prepared from quaternary ammonium salts are especially useful and exhibit improved oxidation stability over organosulfonic acid ammonium salts prepared from other nitrogen bases. The amount of organosulfonic acid ammonium salt incorporated in the lubricating oil is between about 0.05 to 1.0 weight percent, based on the total amount of synthetic ester lubricating oil.

DETAILED DESCRIPTION OF THE INVENTION

In accordance with the invention, the additives for incorporation into synthetic ester oils are organosulfonic acid ammonium salts and contain an organo sulfonate group and an organo ammonium group. The organo sulfonate group in the additive can be obtained from a sulfonic acid or a corresponding metal sulfonate salt of the sulfonic acid. Accordingly, when used in the present specification it is understood that the term "organosulfonic acid ammonium salt" refers to a salt prepared from an organosulfonic acid or organometal sulfonate.

The sulfonic acids used in preparing the additives of the present invention have the general formula $RSO_3H$ where R is a $C_1$-$C_{26}$ hydrocarbyl group, and preferably a $C_1$ to $C_{18}$ hydrocarbyl group. The hydrocarbyl group can be an aliphatic or alicyclic group, such as, an alkyl group, a cycloalkyl group, an aromatic group, a 1 or 2 naphthyl group, an anthryl group, or a phenanthryl group. The alkyl groups can be straight chained or branched and preferably contain from 1 to 10 C atoms. Exemplary of alkyl groups suitable for use in the present invention are a methane group, an ethane group, a heptane group, a hexane group, and the like. The cycloalkyl groups preferably contain from 5 to 12 carbon atoms and exemplary of typical cycloalkyl groups, are a cyclohexyl group, a cyclopentyl group, or a camphor group or the like. Exemplary of suitable aromatic groups are a benzene group, or an ortho-, meta-, or paratoluene group, or a dodecyl benzene group, or a naphthyl or anthranyl group, or the like. The aromatic groups can be substituted by from 1 to 3 alkyl groups where each alkyl group contains from 1 to 20 carbon atoms and the total number of carbon atoms is between 7 to 26.

The sulfonic acids used in the present invention can be made by means well known to the art such as sulfonation of hydrocarbons. See, for example, Kirk-Othmer Encyclopedia of Chemical Technology, Second Edition, Volume 19, pp. 311–319. The sulfonic acids generally will have molecular weights of about 96 to about 600, and can be either pure compounds or prepared by sulfonating petroleum fractions.

Representative of the organosulfonic acids that can be used in preparing the additives employed in the present invention are p-toluenesulfonic acid, 2-naphthalenesulfonic acid, dodecylbenzenesulfonic acid, DL-camphorsulfonic acid, and methanesulfonic acid. Further examples of these sulfonic acids include alkylated benzenes or naphthalenes, having 1 to 4 alkyl groups of 8 to 20 carbons each, such as: dinonylbenzenesulfonic acid, trinonylbenzenesulfonic acid, didodecylbenzenesulfonic acid, dicetylnaphthalenesulfonic acid, diisononylbenzylsulfonic acid, wax substituted benzenesulfonic acids, and the like. Petroleum sulfonic acids may also be used, such as mahogany sulfonic acid, white oil sulfonic acid, mineral oil sulfonic acid, petrolatum sulfonic acid, and the like. The organo sulfonate group can also be obtained from the corresponding salts of such acids such as the sodium salts of such acids.

In accordance with the invention, the additives contain an ammonium group obtained from a nitrogen base including primary, secondary or tertiary amines or the acid addition salts or quaternary ammonium salts thereof. Mixtures of such amines or of such salts can also be used. The ammonium group of the nitrogen base used in the preparation of the additive of this invention has the general formula $NR^1R^2R^3R_x^4$ where $x$ is 0 when the nitrogen base is a primary, secondary or tertiary amine or acid addition salt of such an amine, $x$ is 1 when it is a quaternary ammonium salt, and $R^1$,$R^2$,$R^3$, and $R^4$ are each hydrogen or $C_1$-$C_{36}$, preferably $C_1$-$C_{28}$ hydrocarbyl groups, provided at least one of $R^1$, $R^2$, $R^3$ or $R^4$ is a $C_1$-$C_{36}$ hydrocarbyl group.

The nitrogen bases which can be employed to produce the ammonium addition salts used in the present invention can have aliphatic or alicyclic hydrocarbyl radicals such as alkyl, aryl, alkaryl, or aralkyl radicals. The alkyl radicals or the alkyl portion of the radicals are either of straight chain or branched chain character and contain from $C_1$-$C_{36}$ carbon atoms per hydrocarbyl radical. Representative alkyl radicals include methyl; ethyl; propyl; butyl; hexyl; decyl; tertiary butyl methyl; 1,1-decyl, amyl; lauryl; myristyl; cetyl (palmityl); stearyl; arachidyl; behenyl; lignoceryl; and cerotyl. Aromatic or alkyl aromatic radicals suitable for use include phenyl, naphthyl, o, m or p, -tolyl, a $C_6$-$C_{18}$ alkyl phenyl or naphthyl, benzyl and dibenzyl as well as the corresponding phenethyl radicals. Suitable cycloaliphatic radicals include cyclohexyl, cyclopentylmethyl, cyclopentyl and the like. N-methylphenyl amine; N-butyltolyl amine, o, m, or p, dodecylphenylamine, o, m, or p, nonylphenylamine, and the like are examples of useful mixed alkyl, aryl and alkaryl amines.

Many of the nitrogen bases are commercially available as mixtures, such as amines derived from $C_{12}$ oxo alcohol bottoms. For example, a mixed branched chain isomeric, 1,1-dimethyl $C_{12}$-$C_{14}$ primary aliphatic amine composition is sold under the tradename "Primene 81-R", and a mixed branched chain isomeric 1,1-dimethyl $C_{18}$-$C_{22}$ primary amine composition is sold under the tradename "Primene JMT". Moreover, many of the amine mixtures sold under the "Armeen" trademark are likewise suitable compositions to be employed in producing the sulfonic acid ammonium salts. These amines contain alkyl radicals ranging from $C_{12}$ through $C_{18}$ or mixtures thereof which are derived from fatty acids. The corresponding $C_2$-$C_{20}$ polyalkylene polyamines are alsc useful.

As used in this description and accompanying claims, the term "hydrocarbyl" is intended to include not only hydrocarbon radicals of aliphatic or alicyclic character but also includes the simple derivatives thereof such as the hydroxy derivative. Thus hydroxy amines can be used in the preparation of the additives. Such hydroxy amines can be conveniently prepared by reacting a simple amine with an alkylene oxide. For example, the dipropyl amine can be reacted with a long chain epoxide such as

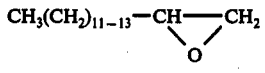

to prepare a tertiary amine alcohol. Amine esters may also be used. They may be prepared by the esterification of the amine alcohol.

Representative of suitable amines and ammonium salts which can be used are the following: n-butylamine; decyl amine; N-phenyl nonyl amine; tertiary butylamine; tri-n-butylamine; triethyl amine; N,N-di-n-propyl-2(hydroxy) pentadecylamine; N,N-di-n-butyl-2(lauroyloxy) pentadecylamine, octylamine; nonylamine; 2-ethylhexylamine, hexylamine; N,N-dimethylhexylamine; N,N-diethylheptylamine; N,N-dibutylamylamine; N,N-dimethyloctylamine; N-methyloctylamine; N-ethylhexylamine; dioctylamine; N,N-diamylcyclohexylamine; dicyclohexylamine; N,N-dihexylbenzylamine; N-octylphenethylamine; and the like, as well as water soluble acid addition salts of such amines with acids such as hydrochloric, sulfuric, acetic, citric, tartaric, hydrobromic and phosphoric. Quaternary ammonium salts are also operative, including trimethylhexylammonium chloride, triethyloctylammonium bromide, dimethyldicyclohexylammonium chloride and benzyldimethylhexyl ammonium chloride.

The formation of the amine addition salts of the sulfonic acids can be easily carried out by means well known to those of ordinary skill in the art. The reaction can be carried out at room temperature, but because of the relatively high molecular weight of some of the amines and of some of the sulfonic acids that are solids at normal or atmospheric temperatures, these compounds may be reacted under elevated temperatures of from about 50° C. to as high as 150° C. Alternatively, the amines and sulfonic acid can be reacted as solutions at ambient temperatures in organic solvents to form the acid addition salts. Suitable solvents are hydrocarbon solvents such as naphtha, benzene, toluene, pentane, hexane, petroleum ether, or the lower alcohols such as ethanol, isopropanol, butanol, the ester base oils, amyl acetate and other conventional carboxylic acid ester solvents, and the like. The amine addition salts of the sulfonic acids can also be formed in situ by the separate additions of the two reactants directly to the base oil.

Sufficient amounts of the primary, secondary or tertiary amines, or mixtures thereof, may be employed so as to give a pH of the reaction mixture of slightly less than 7.0, i.e., 6.5, but preferably a pH of at least 7.0 is used in order to insure that for the most part the sulfonic acids are neutralized. Usually, sufficient amine is incorporated into the reaction to give a final pH of about 7.5. After the required amount of amine has been added to the sulfonic acid reaction mixture, and thorough agitation has insured a completion of the reaction (neutralization), the solvent, if used and not an ester base oil, may be stripped from the reaction mixture while distilling the same therefrom. This conveniently is accomplished under a vacuum, i.e., 1–5 millimeters of mercury vacuum and at a temperature of from 50° to 120° C.

In preparing the sulfonic acid amine products used in the present invention, the amine and sulfonic acid are chosen so that the final product has from about 2 to about 52, preferably 9 to 36 carbon atoms. In this regard, it should be noted that the organosulfonic acid ammonium containing additives are most effective when they possess at least sufficient oil solubility so that the required or desired amounts thereof will be dissolved in the synthetic ester oil. Thus, a hydrocarbyl amine of a low number of carbon atoms will generally be used to neutralize a hydrocarbyl sulfonic acid of a high number of carbon atoms or a hydrocarbyl amine of a high number of carbon atoms will be used to neutralize a hydrocarbyl sulfonic acid of a low number of carbon atoms so as to insure this desired solubility.

The organosulfonic acid ammonium salts used as additives in the present invention can also be made by reacting an amine hydrochloride or similar salt with a metal sulfonate salt to precipitate, for example, a metal chloride such as sodium chloride. Such reactions often occur under milder conditions than the aforesaid direct reaction of the amine with the free sulfonic acid. In certain direct reactions between an amine and a sulfonic acid, a buffering effect is obtained resulting in a pH of about 5.5–6 instead of the desired neutral point pH of 7. Reaction between a metal sulfonate and amine acid addition salt forces the reaction toward completion and can be successfully used to obtain a neutral organosulfonic ammonium salt.

The synthetic ester base stock lubricating oils used in the compositions of this invention are those that are conventionally used in synthetic ester lubricants and include diesters, triesters, tetraesters and other higher esters, polyol esters, complex esters, and mixtures of these esters.

The synthetic ester lubricating oils useful in the present invention have been described in numerous prior art patents such as for example U.S. Pat. Nos. 2,837,567, 2,911,368, 3,634,242 and 3,642,632, which are hereby incorporated by reference for further exemplification of suitable esters. The ester base stocks generally have a major proportion of one or more compounds having the following structural formula:

| | |
|---|---|
| $R_2OOCR_1COOR'_2$ | $R_2OOCR_1COOR_4OOCR_3$ |
| $R_3COOR_4OOCR'_3$ | $R_2(OOCR_1COOR_4)_nOOCR'_1COOR'_2$ |
| $R_3COOR_4(OOCR_1COOR'_4)_nOOCR'_3$ | |

In all the above formulae, $R_1$ and $R'_1$ are the residues of dicarboxylic acids, e.g., $HOOCR_1COOH$. $R_2$ and $R'_2$ are the residues of monohydric alcohols, e.g., $R_2OH$. $R_3$ and $R'_3$ are the residues of monocarboxylic acids, e.g. $R_3COOH$. $R_4$ and $R'_4$ are the glycols, e.g., $HOR_4OH$. "$n$" is a number from 1 to 6 which need not necessarily be integral and, where it is fractional, represents the average of a mixture of compounds. It is preferred that the monohydric alcohols be aliphatic alcohols, or ether alcohols.

Some branching in the hydrocarbon chain of the radical $R_2$ is possible, and the alcohols derived from the Oxo synthesis discussed below may be used. Generally $R_2$ has from 4 to 18 carbon atoms and can contain in certain instances oxygen atoms in the form of ether linkages.

The monocarboxylic acids, $R_3COOH$, are preferably aliphatic acids. Among the monobasic acids which may be employed in the preparation of the esters used in the present invention, the following may be listed as illustrative:

| | |
|---|---|
| Acetic Acid | Propionic acid |
| Butyric acid | Valeric acid |
| Caproic acid | Caprylic acid |
| Pelargonic acid | Stearic acid |
| Oleic acid | β-Methoxypropionic acid |
| β-Tert.-Octoxypropionic acid | |

Preferred monobasic acids have the formula $R_3COOH$, wherein $R_3$ is an alkyl group having from 1 to 22 carbon atoms.

The glycols employed in preparing the esters useful in the present invention are preferably members of the alkylene glycol or polyalkalkylene glycol series. The glycols preferably have 2 to 18 carbon atoms and include ethylene glycol and any of the paraffinic homologues of the same containing up to 18 carbon atoms. These may include, for example, ethylene glycol, propylene glycol, neopentyl glycol, pinacol, trimethylene glycol, tetramethylene glycol, pentamethylene glycol and the like. Compounds such as diethylene glycol, triethylene glycol, the polyethylene glycols of the formula:

$$HOCH_2CH_2O(CH_2CH_2O)_nH$$

wherein $n$ is 0 to 26, and the polypropylene glycols of the general formula:

$$HO(\overset{R_5}{\overset{|}{C}}H-\overset{R_6}{\overset{|}{C}}HO)_nCH-\overset{R_5}{\overset{|}{C}}H-\overset{R_6}{\overset{|}{C}}HOH$$

where either $R_5$ or $R_6$ is a methyl group and the other is hydrogen, and where $n$ is 0 to 20, may be employed. Diols of the formula $H\text{-}(OCH_2CH_2)_nOH$ where $n$ is from 3 to 12 are also useful.

The synthetic diesters can be made by the reaction of a monohydric alcohol with a diacid or by the reaction of a monocarboxylic acid with polyol. The monohydric alcohols, $R_2OH$, useful for making such diesters contain 1 to 18 carbon atoms. Typical alcohols are the following: methyl alcohol, ethyl alcohol, n-butyl alcohol, 2-ethyl hexyl alcohol, n-octyl alcohol, decyl alcohol, $C_8$ Oxo alcohol and $C_{10}$ Oxo alcohol.

A group of alcohols which can be used in preparing the synthetic esters used in the present invention are the so-called "Oxo" alcohols, prepared by the well-known Oxo synthesis. This process involves the catalytic reaction of olefins with carbon monoxide and hydrogen at elevated temperatures of about 300° to 400° F. and pressures of about 2500 to 4000 psig to form, particularly in the presence of cobalt catalysts, aldehydes having one carbon atom more than the olefin originally used. The aldehyde is catalytically hydrogenated to the corresponding alcohol which is recovered as an overhead product by distillation of the reaction mixture. The distillation residue, i.e., the so-called "Oxo-bottoms," is rich in by-product alcohols of higher molecular weight. This residue may also be employed.

While the exact compositions of all these alcohols are not known, it is well established that they are mixtures of primary alcohols, at least a substantial proportion of which is of the branched-chain type. The overhead alcohol product consists of a mixture of such alcohols averaging 1 carbon atom more than the olefin originally fed to the "Oxo" synthesis. Oxo alcohols containing in the range of about 6 to 13 carbon atoms are preferred for the purposes of the present invention.

Esters having suitable properties for the purposes of this invention may be prepared from Oxo alcohols produced by reacting telomers of $C_3$ and $C_4$ monoolefins in the presence of oxonation catalysts as described above. Appropriate mixtures of these monoolefins are readily available in refinery gases, and processes for their conversion into liquid telomers are well known in the art. In accordance with the most widely used of these processes, the olefins are contacted in the liquid phase with a telomerization catalyst comprising phosphoric acid supported on kieselguhr. Other similar processes use as catalysts silica gel impregnated with phosphoric acid, or sulfuric acid, Friedel-Crafts catalysts, activated clays and others. Telomerization conditions in the presence of phosphoric acid catalysts include temperatures of about 300° to 500° F. and pressures of about 250 to 5,000 psig. The olefinic feed stocks normally contain about 15 to 60 mol percent of propylene, about 0.5 to 50 mol percent of butylenes and from 0.1 to 10 mol percent of isobutylene, the remainder being saturated hydrocarbons having 2 to 4 carbon atoms per molecule. In place of, or together with, these olefin mixtures, the dimer and trimer of isobutylene as well as tri-, tetra- and pentapropylene may be used.

Illustrative examples of the dibasic acids, $HOOCR_1COOH$, which may be employed in the synthesis of the diesters and complex esters used in the present invention are the following:

| | |
|---|---|
| Oxalic acid | Malonic acid |
| Succinic acid | Glutaric acid |
| Adipic acid | Pimelic acid |
| Suberic acid | Azelaic acid |
| Sebacic acid | Brassylic acid |
| Tetracosane dicarboxylic acid | $C_4$-$C_{24}$ Alkenyl succinic acids |
| Diglycolic acid | |

Carbon-alkyl derivatives of the above acids, as, e.g. 2-methyl adipic acid, iso sebacic acid, $\alpha$, $\alpha'$, diethyl adipic acid.

The $C_4$-$C_{24}$ alkenylsuccinic acids listed above are prepared by condensing olefins or mixtures of olefins with maleic anhydride. Generally, the dibasic acids used to prepare the esters used in this invention contain 4 to 22 carbon atoms. Preferred dibasic acids have the formula:

$$HOOC(CH_2)_xCOOH$$

where $x$ is a number of from 2 to 10.

The esters used in this invention also include polyesters such as diesters, triesters and tetraesters formed by reacting di-, tri- and tetra hindered polyols such as neopentyl glycol, trimethylol propane, pentaerythritol, dipentaerythritol, trimethylolethane, and higher trimethylol alkanes, and so forth, with a $C_4$-$C_{24}$ normal or branched chain monocarboxylic acid or mixtures of two or more of such types of acids. These acids are exemplified by n-butanoic acid, valeric acid, caproic acid, heptanoic acid, caprylic acid, pivalic acid, 2-ethyl hexanoic acid, pelargonic acid, lauric acid and the like. The hexaesters of dipentaerythritol are also useful alone or admixed with the aforementioned tetraesters of monopentaerythritol. Either the pure mono, pure di, or mixed pentaerythritols are used. One commercially available technical grade pentaerythritol contains as much as 10–15% of the dimer form and may be used as the alcohol reactant as marketed.

The following esters are exemplary of the different types of esters that can be used;

a. esters of monobasic acids: the ester of $C_8$ Oxo alcohol with $C_8$ Oxo acid, and the ester of $C_{13}$ Oxo alcohol with octanoic acid;

b. esters of dibasic acids: di-2-ethyl hexyl sebacate, di-ethyl hexyl adipate;

c. esters of glycols: $C_{13}$ Oxo acid diester of tetraethylene glycol;

d. complex esters: the complex ester formed by reacting one molecule of sebacic acid with two moles of a glycol and two moles of 2-ethyl-hexanoic acid; the complex ester formed by reacting one mole of polyethylene glycol with two moles of sebacic acid and two moles of 2-ethyl hexyl acid; and the complex ester formed by reacting together one mole of azelaic acid, one mole of polyethylene glycol, one mole of $C_8$ Oxo alcohol, and one mole of $C_8$ Oxo acid; and e. mixtures of any of the above in any proportion.

The synthetic ester oils or blends thereof generally have physical properties and specifications as follows: a viscosity index of at least 100, a pour or freezing point not exceeding −40° F., a boiling or decomposition temperature of at least 500° F., a Cleveland Open Cup Flash Point of at least 400° F., and a kinematic viscosity of less than 10 centistokes at 210° F., preferably between 3 cs. and 7.5 cs. The supersonic turbine engine oils have a more exacting specification and requirement. These specifications are: a viscosity index of at least 100, a pour or freezing point not exceeding −45° F., a boiling or decomposition temperature of at least 600° F., a Cleveland Open Cup Flash Point of at least 450° F., and a kinematic viscosity of less than 5.5 centistokes at 210° F., preferably between 5 cs. and 5.5 cs.

The preparation of the lubricating compositions of the present invention involves no special techniques. Generally, the lubricants are formed by adding an appropriate amount of the organosulfonic acid ammonium salt additive to the synthetic ester oil basestock and heating and stirring the composition until the additive is dissolved.

The amount of organosulfonic acid ammonium salt incorporated into the synthetic neutral ester lubricant base stock generally varies between about 0.05 and about 1.0 parts per 100 parts by weight of the base ester oil and, preferably, about 0.1 to about 0.5 parts of the additive is employed.

Other lubricating additives conventionally incorporated in synthetic ester lubricating oils can be added to the lubricating compositions of the present invention in amounts of 0.01 to 5 weight percent each, based on the total weight of the composition. Examples of such additives include, but are not limited to, viscosity index improvers, corrosion inhibitors, thickeners, sludge dispersants, rust inhibitors, anti-oxidants, dyes, dye stabilizers, and the like.

The following examples are given by way of illustration to further explain the principles of the invention. These examples are merely illustrative and are not to be understood as limiting the scope and underlying principles of the invention in any way. All percentages and parts referred to herein are by weight unless otherwise specifically indicated.

EXAMPLE 1

This example illustrates the preparation of an additive prepared in accordance with the present invention. 12.5 grams of p-toluenesulfonic acid are dissolved in 100 milliliters of 95% ethanol. The solution is stirred at room temperature and 23.4 grams of Primene JMT sold by Rohm and Haas are added dropwise to it until a pH of 7.6 is reached. The alcohol is then removed by distillation under 100 to 10 millimeters of mercury. The product is finally stripped at 120° C. under a pressure of 0.5 millimeters of mercury. The yield of product was 90%. Infrared analysis of the product shows that it contains primarily an ammonium sulfonate salt.

EXAMPLE 2

The general procedure of Example 1 is repeated except that the p-toluenesulfonic acid is replaced with 10.0 grams of 2-naphthalenesulfonic acid and the Primene JMT is replaced with 9.0 grams of Primene-81R, sold by Rohm & Haas. The Primene-81R is added dropwise until a pH of 7.6 is reached. The yield of product was 90%.

EXAMPLE 3

The general procedure of Example 1 is repeated except that the p-toluenesulfonic acid is replaced with 10 grams of 2-naphthalene sulfonic acid and the Primene JMT is replaced with 9.5 grams of tri-n-butylamine. The tri-n-butylamine is added dropwise until a pH of 8.2 is reached. The yield of product was 16.3 grams (84%).

EXAMPLE 4

This general procedure of Example 1 is repeated except that the p-toluenesulfonic acid is replaced with 20 grams of dodecylbenzenesulfonic acid and the Primene JMT is replaced with 20.7 grams of tri-n-butylamine. The tri-n-butylamine is added dropwise until a pH of 7.6 is reached. The yield of product was 36.2 grams (89%).

EXAMPLE 5

This general procedure of Example 1 is repeated except that the p-toluenesulfonic acid is replaced with 10 grams of camphorsulfonic acid and the Primene JMT is replaced with 4.2 grams of triethylamine. The triethylamine is added dropwise until a pH of 7.6 is reached. The yield of product is 13.8 grams (97%).

EXAMPLE 6

This general procedure of Example 1 is repeated except that the p-toluenesulfonic acid is replaced with 10.0 grams of camphorsulfonic acid and the Primene JMT is replaced with 8.0 grams of tri-n-butylamine. The tri-n-butylamine is added dropwise until a pH of 7.5 is reached. The yield of product is 12.1 grams (67%).

EXAMPLE 7

The general procedure of Example 1 is repeated except that the p-toluenesulfonic acid is replaced with 20.0 grams of methanesulfonic acid and 54.4 grams of Primene JMT are added dropwise until a pH of 7.6 is reached. The yield of product is 63.1 grams (85%).

EXAMPLE 8

The general procedure of Example 1 is repeated except that the p-toluenesulfonic acid is replaced with 20.0 grams of methanesulfonic acid and the Primene JMT is replaced with 16.3 grams of tri-n-butylamine. The tri-n-butylamine is added dropwise until a pH of 7.6 is reached. The yield of product is 28.0 grams (77%).

EXAMPLE 9

This example illustrates the preparation of N-N-di-n-butyl-2-(lauroyloxy) pentadecylammonium methanesulfonate from a sulfonic acid salt and an amine salt.

The amine salt is prepared by first adding 25.4 grams (0.2 mole) of di-n-butylamine and 49.6 grams (0.21 mole) of a $C_{14}$-$C_{16}$ olefin oxide to a 100 ml flask and heating with stirring. The reaction temperature gradually rises from 100° C. to about 200° C. during 3 hours and is kept at 215° C. for an additional 4 hours. Gas chromatographic and infrared analysis of the product indicate virtually complete conversion of starting materials. The product is vacuum stripped to 150° C. at 0.5 mm yielding 94% of adduct. Lauroyl chloride in the amount of 23.0 grams (0.105 mole) is dissolved in 150 ml dry benzene and cooled with stirring to 10° C. 35.4 grams (0.096 mole) of adduct is added dropwise to the lauroyl chloride over a period of 1 hour. The mixture is allowed to stir at room temperature for 1 hour and is then heated to 60° C. for 1 hour. The reaction mixture is allowed to cool and dry HCl gas is slowly bubbled through for 5 minutes. The solvent is removed under reduced pressure and the resulting ester amine hydrochloride is used without further purification.

The sulfonic acid salt is prepared by neutralizing 4.30 grams neat (0.045 mole) of a solution of 70% methanesulfonic acid in 40 ml of 95% ethanol with a 10% sodium hydroxide solution.

25.6 grams (0.045 mole) of the ester amine hydrochloride is added with stirring to the sodium methanesulfonate solution. The reaction mixture is filtered from the NaCl precipitate and the solvent is removed under vacuum to provide a 64% yield (19.0 gram)(0.029 mole) of product.

EXAMPLE 10

This example illustrates the preparation of N-N-di-n-propyl-2-(hydroxy) pentadecylammonium methanesulfonate from a sulfonic acid salt and amine salt.

The amine salt is prepared by first adding 20.2 grams (0.2 mole) di-n-propylamine and 48.6 grams (0.21 mole) of a $C_{14}$-$C_{16}$ olefin oxide to a 100 ml flask and heating with stirring. The reaction temperature gradually rises from 100° C. to about 210° C. during 3 hours and is kept at 215° C. for an additional 4 hours. Gas chromatographic and infrared analysis of the product indicate virtually complete conversion of starting materials. The product is vacuum stripped to 150° C. at 0.5 mm yielding 94% of adduct. The reaction mixture is allowed to cool and dry HCl gas is slowly bubbled through for 5 minutes. Excess HCl gas is removed under reduced pressure and the resulting hydroxyamine hydrochloride is used without further purification.

The sulfonic acid salt is prepared by neutralizing 4.30 grams neat (0.045 mole) of a solution of 70% methanesulfonic acid in 40 ml of 95% ethanol with a 10% sodium hydroxide solution.

16.8 grams (0.045 mole) of the hydroxyamine hydrochloride is added with stirring to the sodium methanesulfonate solution. The reaction mixture is filtered from the NaCl precipitate and the solvent is removed under vacuum to provide a 64% yield (12.6 grams) (0.029 mole) of product.

EXAMPLE 11

The additives of Examples 1–10 are formulated in a series of synthetic ester oil base stocks prior to being evaluated in certain standard lubricant tests. The following five synthetic base stocks are used in preparing the lubricating compositions.

Base stock Oil A is a tetraester of pentaerythritol with a mixture of $C_4$-$C_7$ normal alkanoic acids sold under the trade name Hercolube A by Hercules, Inc.

Base stock Oil B is a mixture of about 90 wt. % of pentaerythritol and 10% of dipentaerythritol esterified with a mixture of $C_5$-$C_9$ normal alkanoic acids.

Base stock Oil C is a fully formulated lubricating oil comprising a mixture of 100 parts of Oil B, 1.6 parts of dioctyldiphenylamine (an anti-oxidant), 0.4 part phenothiazine (an anti-oxidant), 0.02 part sebacic acid (a lead corrosion inhibitor), 0.1 part quinizarin (an anti-oxidant-/corrosion inhibitor), 0.1 part anthranilamide acid (a copper corrosion inhibitor), and 1.0 part tricresylphosphate, (extreme pressure agent).

Base stock Oil D is a fully formulated oil composition containing 70 parts of a triester of trimethyol propane esterified with a mixture of $C_7$ to $C_9$ alkanoic acids. 30 parts of a hexaester of dipentaerythritol esterified with a mixture of $C_5$ to $C_{10}$ alkanoic acids sold under the tradename Hercolube F by Hercules, Inc.; 1.3 parts dioctyldiphenylamine (an anti-oxidant and dispersant), 1.1 parts $\alpha$-phenylnaphthylamine (an anti-oxidant), 3.0 parts tricresyl phosphate (an extreme pressure agent), 0.1 part benzotriazole (a copper corrosion inhibitor), and 0.02 part sebacic acid (a lead corrosion inhibitor).

Base stock Oil E is a fully formulated oil composition containing 100 parts of Oil B, 1.3 parts dioctyldiphenyl amine (an anti-oxidant and dispersant), 1.1 parts $\alpha$-phenylnaphthylamine (an anti-oxidant), 3.0 parts tricresyl phosphate (an extreme pressure agent), 0.1 parts benzotriazole (a copper corrosion inhibitor), and 0.02 parts sebacic acid (a lead corrosion inhibitor).

Table 1 summarizes some of the physical properties of these oils.

TABLE 1

| | Properties of Base Oils | | |
|---|---|---|---|
| | Viscosity, cs. | | Ryder Gear Load-Carrying |
| Oil | at 210° F. | at −40° F. | Capacity, ppi |
| A | 4.3 | 4900 | 2400 |
| B | — | — | 2800 |
| C | same as Oil B | | 2800 |
| D | — | — | — |
| E | | | |

The extreme pressure properties of a number of lubricant compositions formulated from the organosulfonic acid ammonium salts of Examples 1 to 10 and the above base stocks are evaluated in the Ryder gear test using the Ryder gear machine described in ASTM Method D-1947. Briefly, this test subjects a set of gears lubricated by the test oil to a series of load increments under controlled conditions. The amount of tooth-face scuffing occurring at each load is measured. The percentage of tooth-face scuffing is plotted against the load to determine the load-carrying ability of the test oil. The load-carrying ability of the oil is defined as the tooth load, in pounds per inch of gear tooth, at which an average tooth-face scuffing at 22.5% of the tooth area has been reached. Table 2 lists the components of each lubricating composition and the results of the tests.

TABLE 2

| Lubricating Composition | | | Ryder Gear Testing | | | |
|---|---|---|---|---|---|---|
| Additive | Oil Base Stock | Add Conc.[1] | Side A | Side B | Av. ppi. | Δ Load ppi |
| Example 1 | A | 0.1 | 3015 | 2756 | 2886 | 486 |
| Example 2 | A | 0.2 | 3220 | 3102 | 3161 | 761 |
| | A[2] | 0.2 | 3302 | 2500 | 2901 | 501 |
| Example 4 | B | 0.3 | 3592 | 3717 | 3655 | 855 |
| | A | 0.25 | 3039 | 2851 | 2945 | 545 |
| | B | 0.2 | 3591 | 3228 | 3410 | 610 |
| | B | 0.1 | 3038 | 3118 | 3078 | 278 |
| Example 6 | B | 0.3 | 3469 | 3089 | 3279 | 479 |
| Example 8 | B | 0.3 | 4183 | 4088 | 4136 | 1336 |
| Example 9 | B | 0.2 | 3835 | 3482 | 3659 | 859 |
| Example 10 | B | 0.2 | 3475 | 3409 | 3442 | 642 |

[1]Parts of Additive per 100 parts base stock
[2]Contains 1.0 part by weight of tricresyl phosphate per 100 parts by weight oil.

From an examination of these results, it can be seen that the lubricant compositions of this invention increase the average load-carrying capacity of the oil from 300–1300 lbs. per inch of gear tooth. For example, from the data in Table 2, it can be seen that the methanesulfonic acid-tri-n-butyl product of Example 8 in a concentration of 0.3 parts by weight per 100 parts by weight of oil gave an increase in the average load-carrying capacity of the oil of over 1,300 pounds. Thus, alkanesulfonic acids are among the preferred embodiments of the present invention.

EXAMPLE 12

This example shows the results of Seal Swell tests and Seal Condition tests conducted on a number of lubricant compositions formulated from the organic sulfonic acid ammonium salts of Examples 1 to 10 and the oil base stocks of Example 11.

The Elastomer Swell Test is carried out according to Federal Test Method FTM-3604.1. Briefly, the volume of a test specimen of rubber before and after being soaked in the test oil under stated conditions of time and temperature is determined by weighing the rubber specimen in air and in water and calculating the water displaced. The resulting swell is expressed as a percent change from the original volume after soaking in the oil.

The Elastomer Condition Test is carried out by bending the rubber specimen around a ¼ inch glass rod and observing if cracking occurs using a X-10 magnification. For a pass, no cracking should be observed and the surface of the elastomer should neither be soft nor tacky nor brittle nor flaky. The rubbers used for these elastomer evaluation tests are the following:

| RUBBER | | |
|---|---|---|
| | Source | Composition |
| FS | Dow Corning | Fluorosilanes |
| Sirvene | Chicago Rawhide | Polydimethylsiloxane and variations |

-continued

| | Source | RUBBER Composition |
|---|---|---|
| H Rubber | Goodrich | Butadiene acrylonitrile |
| F Rubber | duPont | Vinylidene fluoride, hexafluoro propylene copolymer |

All tests are conducted for 72 hours under the following temperature conditions: FS rubber, 302° F; Sirvene, 302° F; H rubber, 158° F; F rubber, 400° F.

The results of the tests and the components of each lubricating composition are listed in Table 3 below.

TABLE 3

ELASTOMER TESTS OF VARIOUS OIL COMPOSITIONS

| Lubricating Composition | | | | | |
|---|---|---|---|---|---|
| Additive | Oil Base Stock | Add Conc.[1] | Elastomer | % Swell | Condition |
| Example 1 | C | 0.1 | FS | 3.07 | pass |
| Example 2 | C | 0.5 | FS | 2.54 | pass |
| | B | 0.2 | FS | 2.17 | pass |
| | B | 0.2 | Sirvene | 4.36 | pass |
| | B[2] | 0.2 | FS | 1.94 | pass |
| | B[2] | 0.2 | Sirvene | 5.29 | pass |
| Example 3 | C | 0.1 | FS | 2.82 | pass |
| Example 4 | C | 0.3 | FS | 3.65 | pass |
| | C | 0.3 | Sirvene | 5.85 | |
| | C | 0.3 | H Rubber | 13.81 | pass |
| | C | 0.3 | F Rubber | 14.93 | pass |
| | C | 0.1 | FS | 3.59 | pass |
| Example 5 | C | 0.3 | FS | 4.09 | pass |
| | C | 0.1 | FS | 3.86 | pass |
| Example 6 | C | 0.3 | FS | 4.03 | pass |
| | C | 0.1 | FS | 3.34 | pass |
| Example 7 | C | 0.3 | FS | 4.34 | pass |
| Example 8 | C | 0.3 | FS | 3.47 | pass |
| Example 9 | C | 0.2 | FS | 4.93 | pass |
| | C | 0.1 | FS | 4.57 | pass |
| | D | 0.1 | FS | 3.41 | pass |
| Example 10 | B | 0.2 | FS | 5.17 | pass |
| | C | 0.1 | FS | 4.86 | pass |

[1]Parts of additive per 100 parts base stock
[2]Contains 1.0 part by weight tricresyl phosphate per 100 parts by weight oil.

The data in Table 3 all show that the additives of this invention do not attack the seal so as to cause it to shrink or cause it to deteriorate with respect to cracking, etc. In contrast, when a similar test is carried out with a prior art additive, the Primene 81R mixed salt of mixed mono- and dimethyl acid phosphate, the FS Rubber had a swell of −9.5 and failed the Seal Condition Test by showing cracks upon bending. This contrast clearly shows that the additives of the present invention are further improvements to those of the prior art with respect to compatability with silicone rubber seals.

EXAMPLE 13

This example shows the results of Oxidation-Corrosion-Stability tests conducted on a number of lubricant compositions containing the organic sulfonic acid ammonium salts of Examples 1 to 10 and the oil base stocks of Example 11.

The 425° F. Oxidation-Corrosion-Stability Test is carried out by blowing air at the ratio of 5 liters per hour through 100 grams of lubricating composition maintained at a temperature of 425° F. for 72 hours. At the end of the test, the percentage increase in viscosity and change in total acid number (T.A.N.) are determined. The corrosive characteristics of the lubricant is determined by immersing various weighed metal coupons in the oil and measuring weight change at the end of the test. The change in weight signifies either corrosion due to dissolving of the metal or weight gain due to deposits. The test is used to determine if lubricants offer sufficient protection for critical metal components of engines and accessories when operated at high temperatures. The 400° F. Oxidation-Corrosion-Stability Test is similar to the 425° F. test except that it is carried out at 400° F. The additives of Examples 4 and 10 are evaluated in the abovedescribed Oxidation-Corrosion-Stability Test both at 400° F. and 425° F. for a period of 72 hours. Also, a base stock oil containing no additive and one containing a prior art phosphate amine additive are also evaluated.

Table 4 lists the components of each lubricating composition and the results of the tests.

TABLE 4

OXIDATIVE CORROSION STABILITY TEST

| Lubricating Composition | | | 400° F/72 hours | | | | 425° F/72 Hours | | | |
|---|---|---|---|---|---|---|---|---|---|---|
| Additive | Oil | Conc. pbw | Cu | Mg | Δ vis[1]% | Δ Tan[3] | Cu | Mg | Δ vis[1]% | Δ Tan |
| None | E | — | −0.03 | +0.04 | 18.42 | 1.19 | −0.33 | −16.16 | 68.94 | 4.94 |
| Example 4 | E | 0.2 | −0.01 | +0.03 | 23.78 | 0.34 | −0.31 | 0.07 | 44.52 | 5.25 |
| Control[2] | C | 0.1 | −0.28 | +0.03 | 23.15 | 2.07 | −0.68 | −3.42 | 51.53 | 7.55 |
| Example 10 | C | 0.2 | −0.23 | +0.01 | 24.84 | 1.59 | −0.34 | −0.34 | 50.53 | 8.46 |

[1]at 100° F.
[2]A commercial load carrying additive, being the acid phosphate salt of a Primene 81R $C_{18}$–$C_{22}$ amine
[3]ASTM D 664

As can be seen from an examination of the data in Table 4, neither the additive of Example 4 nor that of Example 10 contribute significantly with respect to copper or magnesium corrosion or with respect to viscosity increase or total acid number increase. Additionally, the formulations containing the sulfur salts experienced no increase in silver corrosion.

The invention in its broader aspects is not limited to the specific details shown and described and departures may be made from such details without departing from the principles of the invention and without sacrificing its chief advantages.

What is claimed is:

1. A liquid lubricant composition for aircraft engines comprising a major amount of a synthetic ester lubricating oil and about 0.05 to about 1.0 parts per 100 parts by weight of the ester lubricating oil of an oil soluble organo sulfonic acid ammonium salt having a sulfonate group containing a $C_1$ to $C_{26}$ hydrocarbyl group and an ammonium group of the formula $NR^1R^2R^3R^4_x$ wherein $x$ is 0 or 1, and $R^1$, $R^2$, $R^3$ and $R^4$ are each hydrogen or a $C_1$ to $C_{36}$ hydrocarbyl group, provided that at least one of $R^1$, $R^2$, $R^3$ and $R^4$ is a $C_1$ to $C_{36}$ hydrocarbyl group.

2. A lubricant composition according to claim 1 wherein the sulfonate group contains a $C_1$ to $C_{18}$ hydrocarbyl group.

3. A lubricating composition according to claim 1 wherein the sulfonate group contains an alkyl group containing from 1 to 18 carbon atoms.

4. A lubricant composition according to claim 1 wherein the sulfonate group contains an n-dodecylbenzene group, a methane group, a p-tolyl group, a 2-naphthalene group, or a D,L camphor group.

5. A lubricant composition as claimed in claim 2 wherein $x$ is 0 and $R^1$ is a $C_1$ to $C_{18}$ alkyl group.

6. A lubricant composition according to claim 2 wherein $R^1$ and $R^2$ are alkyl groups and $R^3$ is a $C_1$ to $C_{18}$ 2-hydroxy alkyl group.

7. A lubricant composition according to claim 1 wherein $R^1$ and $R^2$ are n-butyl groups and $R^3$ is an n-butyl group or a 2-hydroxy pentadecyl group.

8. A lubricant composition according to claim 1 wherein the sulfonate group contains a methane group and the ammonium group is a di-n-butyl-2(hydroxy) pentadecyl amine group.

9. A lubricant composition according to claim 1 wherein the sulfonate group contains a methane group and the ammonium group is a di-n-butyl-2(lauroyloxy) pentadecyl amine group.

10. A lubricant composition according to claim 1 wherein $x$ is 1 and $R^1$, $R^2$ and $R^3$ are ethyl groups.

11. A lubricant composition according to claim 1 wherein the ammonium group is derived from a mixed branched chain isomeric 1,1-dimethyl $C_{12}$-$C_{14}$ primary aliphatic amine or a mixed branched chain isomeric 1,1-di-methyl $C_{18}$-$C_{22}$ primary amine.

12. A lubricant composition according to claim 1 wherein the synthetic ester oil is an ester of a monocarboxylic saturated fatty acid and a polyol chosen from the group consisting of tri-hydroxy polyols, tetrahydroxy polyols and dimers of said tetrahydroxy polyols.

13. A lubricant composition according to claim 1 wherein from about 0.1 to about 0.5 parts of the oil soluble organo sulfonic acid ammonium salt is present per 100 parts by weight of the ester lubricating oil.

14. A lubricant composition according to claim 13 wherein the sulfonate group contains a $C_1$ to $C_{18}$ hydrocarbyl group.

* * * * *